United States Patent [19]

Zenkner

[11] 4,235,568

[45] Nov. 25, 1980

[54] FAN ROTOR WITH TENSIONING MEANS

[75] Inventor: Kurt Zenkner, Ettlingen, Fed. Rep. of Germany

[73] Assignee: Voith Getriebe KG, Heidenheim, Fed. Rep. of Germany

[21] Appl. No.: 947,615

[22] Filed: Oct. 2, 1978

[30] Foreign Application Priority Data

Oct. 5, 1977 [DE] Fed. Rep. of Germany ..... 2744743

[51] Int. Cl.[3] ..... F04D 29/66

[52] U.S. Cl. ..... 416/187; 416/195

[58] Field of Search ..... 416/178, 187, 195, 184

[56] References Cited

U.S. PATENT DOCUMENTS

| | | | |
|---|---|---|---|
| 1,378,008 | 5/1921 | Candee | 416/187 |
| 1,652,285 | 12/1927 | McMurdie | 416/178 |
| 2,424,501 | 7/1947 | Place | 416/187 |
| 2,637,489 | 5/1953 | Place | 416/184 |
| 3,130,899 | 4/1964 | Brown et al. | 416/187 X |

*Primary Examiner*—Leonard E. Smith

[57] ABSTRACT

A rotor for radial fans wherein the blades which are secured to the peripheries of the end walls surround or are surrounded by a spirally wound rod. The end portions of the rod are fastened to the end walls so as to maintain the median portion of the rod in prestressed condition. The rod enhances the resistance of the rotor to torsional stresses.

15 Claims, 4 Drawing Figures

FAN ROTOR WITH TENSIONING MEANS

Figure 1:
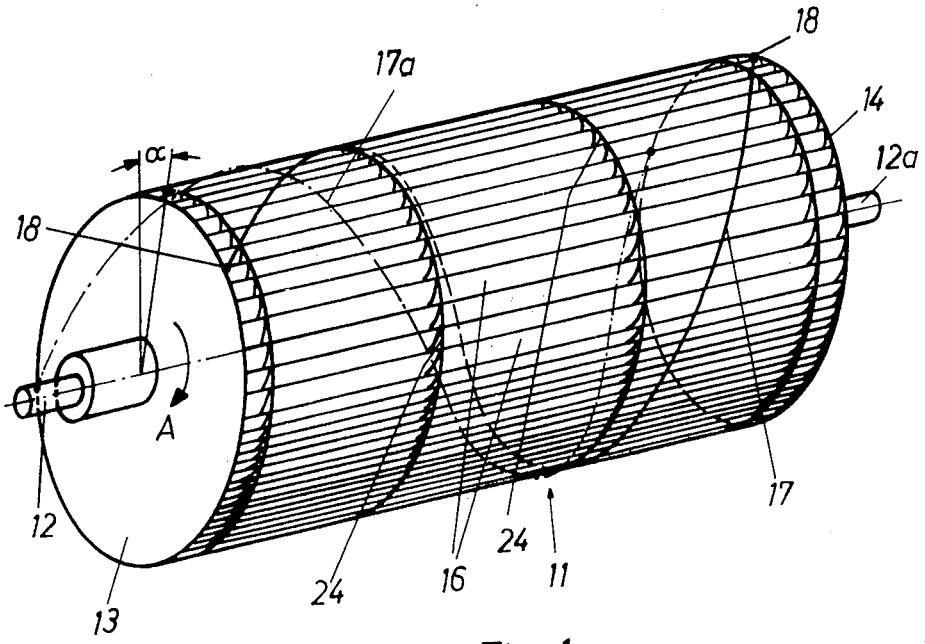

The present invention relates to a fan rotor for a radial fan wherein several blades having a small radial and tangential extension are provided at the circumference of the rotor between two closed rigid end disks or end disk assemblies.

In known fan rotors of such character, the end disks or end disk assemblies are relatively rigid and the blades are inserted into cutouts, recesses or the like of the end disks or end disk assemblies and are welded or otherwise fixedly secured thereto. Though such construction results in a rotor which exhibits an extremely high resistance to bending, the resistance to torsional stresses is still unsatisfactory. In such fan rotors, the characteristic frequency in the direction of torsion is very low so that vibrations of a belt drive can initiate resonant characteristic oscillations in such direction.

Therefore, it is an object of the present invention to provide a fan rotor of the aforementioned type which, in addition to a pronounced resistance to bending stresses, also possesses high resistance to torsional stresses.

In order to accomplish this object, it is proposed in accordance with the invention to provide at least one spirally wound tensioning device, e.g., in the form of a rod, between the end disks or end disk assemblies, to non-movably secure the ends of the tensioning device to the end disks or end disk assemblies, and to make the tensioning device substantially longer than the blades.

In this manner, the fan rotor exhibits an extremely high resistance to torsional stresses because even small torsion angles entail a pronounced change in the length of the wound tensioning device. The wound tensioning device, whose resistance to tensional stresses is relatively high, opposes deformation of the rotor in response to torsional stresses with a strong force. Thus, twisting of the rotor is strongly opposed, particularly in that direction in which the tensioning device is subjected to tensional stresses or (in other words) in which it would tend to contract, as considered in the axial direction. Such effect is strongly enhanced in that, in accordance with an embodiment of the invention, the tensioning device which, for example, may constitute a rod, is secured to the end disks or end disk assemblies in prestressed condition.

In a radial fan, the tensioning device can surround the blades. In many instances, it is desirable to provide two tensioning devices which are spirally wound in opposite directions. The extent of convolution of the tensioning device or devices, too, depends on the requirements; for example, when the tensioning device is a rod, it can be convoluted along approximately 360°.

In order to save space, it may be advisable that at least one tensioning device extend in the interior of the rotor, namely, within and close to the blades. In such instance, it is advisable, in the event that the rotor comprises intermediate disks between the end disks, that the tensioning device extend along a straight path and at an angle to the rotor axis between the end disks and the corresponding neighboring intermediate disk and between two neighboring intermediate disks in such a way that the straight portions which extend between neighboring disks together resemble a spiral in that the ends of the straight portions lie on a spiral.

Figure 2:
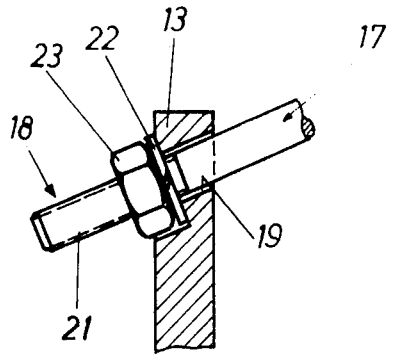
Figure 3:
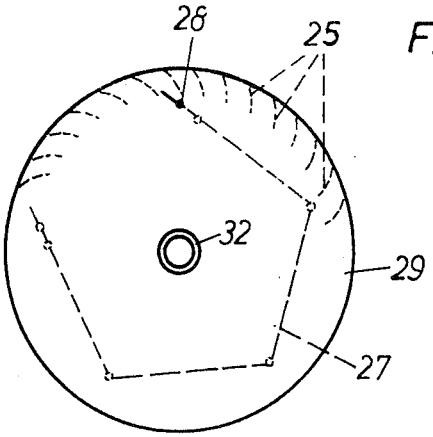
Figure 4:
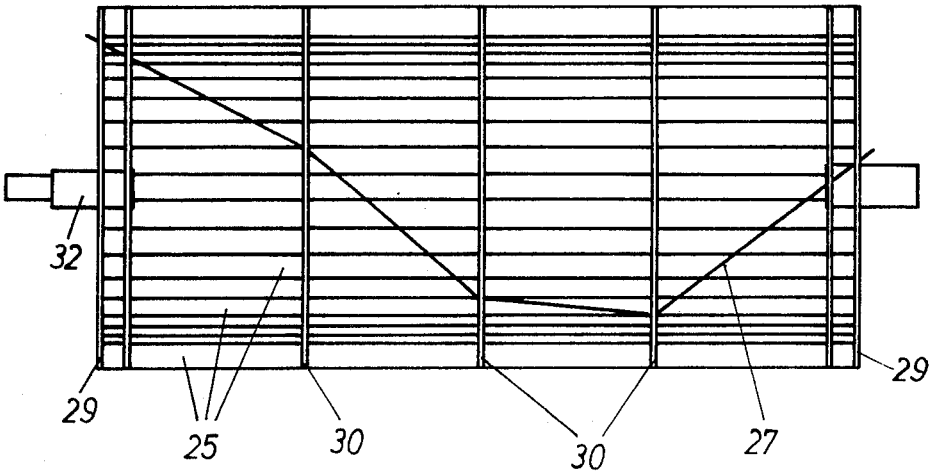

Further details and embodiments of the invention can be found in the following description wherein the invention will be described and explained in greater detail. There are shown in:

FIG. 1 a perspective view of a fan rotor in accordance with one embodiment of the present invention, FIG. 2 in section the manner of securing the ends of a rod to the end disks or end disk assemblies, FIG. 3 an end elevational view of another fan rotor and FIG. 4 the fan rotor according to FIG. 3 in side elevational view, with some of the rotor blades omitted.

FIG. 1 shows in perspective view a rotor 11 which can be utilized, for example, in a radial fan. The rotor 11 comprises a drive shaft 12 which, as a rule, is rigidly connected with the adjacent end disk or wall 13 or a corresponding end disk or wall assembly, end-to-end. A stub shaft 12*a* is also secured to the other end disk or wall 14.

The two lateral end disks 13, 14 are solid disks or sheet metal disks which are formed with reinforcing cavities and constitute end disk assemblies. The peripheries of the end disks 13, 14 are connected with a plurality of schematically indicated blades 16 having a small radial and tangential extension and being held apart by intermediate disks or walls 24. For example, the blades 16 are recessed into cutouts of the disks 13, 14, 24 and are rigidly welded or otherwise secured thereto. The blades 16 exhibit the customary shape with their curved ends extending inwardly and being uniformly distributed at the peripheries of the disks 13, 14, 24. Due to the provision of blades 16 and their rigid connection with the two end disks 13, 14 and with the intermediate disks 24, the rotor 11 exhibits a strong resistance to bending even though it does not comprise a centrally located through shaft which would connect the stub shafts 12 and 12*a*.

The median portion of a spirally wound tension-resistant rod 17 which constitutes a tensioning device extends along the outer circumference of the rotor 11 and essentially along the outer edges of the blades 16. The ends or end portions 18 of the rod are respectively secured to the end disks 13 and 14. The tensioning device 17 need not necessarily be rod-shaped; for example, it can exhibit the shape of a band. In the illustrated embodiment, the median portion of the rod 17, which may consist of solid round material, is spirally wound through slightly more than 360° whereby the lead of the spiral is substantially constant along the full length. The ends 18 of the rod 17 are inserted into bores 19 of the corresponding end disks 13, 14. The bores 19 slant in the direction of the oncoming end 18 of the rod 17.

Each end 18 is provided with a part having an external thread 21 which meshes with a nut 23 with the interposition of a safety washer 22. The nut 23 is tightened to such an extent that the median portion of the rod 17 surrounds the rotor 11 in prestressed condition. In this manner, one achieves that the rotor 11 exhibits an extremely high resistance to torsional stresses in the direction of rotation of the spiral because even small torsion angles alpha entail a pronounced change in the length of the prestressed spirally wound rod 17. Torsion in the direction of arrow A would entail a shortening of the rod 17, and such movement is opposed by the fixedly mounted blades 16 and by prestressing of the rod 17 which constitutes the tensioning device.

As indicated in FIG. 1 by a dot-dash line, it is possible to further provide a second spirally wound tensioning device 17*a*, for example, again in the form of a rod, which is also secured to the end disks 13, 14 or to the corresponding end disk assemblies in prestressed condition and which, however, is wound in the opposite direction. It will be understood that it is also possible to provide torsion resistant rods 17, 17*a* or tensioning devices in such rotors 11 which are of long design and wherein at least one intermediate disk 24 is inserted, the same as in the illustrated embodiment. The rod 17, 17*a* can be a continuous rod which is secured to the intermediate disk or it may be divided into two aligned rods.

In the just described embodiment, each tensioning device, i.e., the rod 17, 17*a* which constitutes the respective tensioning device, is externally adjacent to the blades 16.

However, it is also possible to provide at least one tensioning device 27 which, according to FIGS. 3 and 4, is disposed in the interior of the rotor and is inwardly adjacent to the blades 16. This embodiment occupies less space. In order to achieve a relatively large diameter of the median portion of the spirally wound tensioning device 27, the latter should be provided close to the blades 25. If the rotor comprises intermediate disks 30, such intermediate disks can be provided with passages for the tensioning device 27. The fastening of the end portions of the tensioning device 27 to the end disks 29 or to the end disk assemblies can be effected, in this case, too, in a manner as described in connection with FIG. 2.

FIG. 3 shows a disk 29 of such embodiment, with a stub shaft 32. The tensioning device 27 is indicated by broken lines.

FIG. 3 shows that, within the inner circumference of the schematically indicated blades 25 and in the region of such inner circumference, there is provided a passage 28. A corresponding passage is provided in each disk of the rotor and the passages of different disks are angularly offset with respect to each other to allow for threading of a convoluted tensioning device 27.

If this embodiment comprises intermediate disks 30, as shown in FIG. 4, it is desirable that the median portion of the tensioning device 27, i.e., a rod or the like which constitutes the tensioning device 27, extend along a straight path between two disks 29, 30 and at an angle to the rotor axis. Thus, a straight portion or section of the tensioning device 27 extends in each space between one of the end disks 29 and the corresponding neighboring intermediate disk 30, as well as between each pair of neighboring intermediate disks 30, and a change in the direction of the tensioning device 27 takes place in the region of the passage 28 of each intermediate disk 30. The change in direction is selected in such a way that the portions or sections together imitate a helical shape, i.e., the totality of portions or sections approximates a spiral and the similarity increases with increasing number of intermediate disks 30. In other words, the ends of portions or sections which are disposed in the region of a disk 29, 30 are located on a spiral.

I claim:

1. A rotor, particularly a rotor for radial fans, comprising two spaced-apart coaxial substantially disk-shaped end walls; a plurality of elongated blades secured to the peripheries of said end walls; and a tensioning device including end portions affixed to said end walls and a substantially helical median portion surrounding said blades and having a length exceeding the length of said blades.

2. The rotor of claim 1, further comprising a second tensioning device having end portions affixed to said end walls and a substantially helical median portion surrounding said blades and having a length exceeding the length of said blades.

3. The rotor of claim 2, wherein the lead of said first mentioned median portion is opposite to the lead of the median portion of said second tensioning device.

4. A rotor, particularly a rotor for radial fans, comprising two spaced-apart coaxial substantially disk-shaped end walls; a plurality of elongated blades secured to and extending along an imaginary cylinder coaxially adjoining the peripheries of said end walls; and a tensioning device including end portions affixed to said end walls at two end points of a helical line situated on said imaginary cylinder, and a median portion extending through at least one intermediate point of said helical line and having a length exceeding the length of said blades.

5. The rotor of claim 4, wherein said tensioning device is a rod.

6. The rotor of claim 4, further comprising means for securing said end portions of said tensioning device to the respective end walls in such a way that said median portion is maintained in prestressed condition.

7. The rotor of claim 4, wherein said median portion of said tensioning device extends along an arc of approximately 360°, as considered in the circumferential direction of said rotor.

8. The rotor of claim 4, wherein said median portion surrounds said blades.

9. The rotor of claim 4, further comprising a second tensioning device having end portions affixed to said end walls at two end points of an additional helical line situated on said imaginary cylinder and a median portion extending through at least one intermediate point of said additional helical line and having a length exceeding the length of said blades.

10. The rotor of claim 4, wherein said end walls have inclined bores for the respective end portions of said tensioning device and the inclination of said bores at least approximates the orientation of adjacent parts of said median portion.

11. The rotor of claim 10, wherein said end portions have externally threaded parts extending outwardly beyond the respective end walls, and further comprising nuts meshing with said externally threaded parts.

12. The rotor of claim 4, wherein said blades surround said median portion.

13. The rotor of claim 12, wherein said passage is adjacent to one of said blades.

14. The rotor of claim 12, further comprising at least one intermediate wall disposed between and spaced apart from said end walls, said intermediate wall having a passage for said median portion at said intermediate point.

15. The rotor of claim 14, wherein said median portion includes straight sections at the opposite sides of said intermediate wall.

* * * * *